United States Patent [19]

Frechette

[11] 4,210,296

[45] Jul. 1, 1980

[54] RIBBON CARTRIDGE WITH INTEGRAL ANTI SPOOL ROTATION DEVICE

[75] Inventor: Thomas E. Frechette, Windsor Locks, Conn.

[73] Assignee: Royal Business Machines, Inc., Hartford, Conn.

[21] Appl. No.: 972,996

[22] Filed: Dec. 26, 1978

[51] Int. Cl.[2] ..... B41J 15/00; B65H 75/02

[52] U.S. Cl. ..... 242/198; 242/71.2; 400/208.1

[58] Field of Search ..... 242/198, 199, 71.2; 400/208.1, 242, 248

[56] References Cited

U.S. PATENT DOCUMENTS 2,401,632 6/1946 Greenleaf ..... 242/198

3,706,426 12/1972 Prahl ..... 242/198

3,807,840 4/1974 Cook et al. ..... 242/198

*Primary Examiner*—George F. Mautz

*Attorney, Agent, or Firm*—Joseph R. Spalla

[57] ABSTRACT

Cartridges housing ribbon spools with a length of ribbon extending externally of the cartridge between exit and inlet openings in the cartridge are provided with an integral anti spool rotation device to prevent spool rotation as would allow inadvertent or accidental withdrawal of an undue length of ribbon externally of the cartridge. Incident to mounting the cartridge on a machine, the locking device is moved to a spool release position without detachment or separation from the cartridge for later movement to anti rotation position if removal of an unspent cartridge is required.

4 Claims, 5 Drawing Figures

RIBBON CARTRIDGE WITH INTEGRAL ANTI SPOOL ROTATION DEVICE

This invention relates to ribbon cartridges housing spools of ribbon with a length of ribbon extending externally of the cartridge between exit and inlet openings in the cartridge; more particularly, it relates to a cartridge having a releasable anti spool rotation device; and specifically, to a cartridge having an anti spool rotation device which is integral with and not separable from the cartridge in rotational spool arrest or release positions of the device.

Anti spool rotation locking devices to prevent withdrawal of ribbon prior to mounting ribbon spool assemblies on a machine to prevent ribbon unravelling are know to the art. These prior art anti spool rotation locking devices are separable from the spool assembly either prior to or upon mounting the spool assembly on the machine to allow threading of ribbon in ribbon lift arms and are usually thrown away. Exemplary devices of this type are disclosed in U.S. Pat. No. 3,272,304 issued to Morelli and U.S. Pat. No. 3,396,828 issued to Moshier et al.

Another known form of separable throwaway anti spool rotation device in a ribbon cartridge assembly comprises a removable throwaway flexible rectangular plastic strip which is wedged between the upper ends of the rotatable spool cores which extend through the top cover of a cartridge.

Also known, as shown in FIG. 1, are anti spool rotation devices in the form of removable throwaway plugs, adapted for insertion into a hollow core of a supply spool rotatably mounted in a cartridge. The plugs are provided with a radially directed arm which extends into a ribbon indicator slot in the top cover of a cartridge thus to prevent rotation of the spool core relative to the cartridge. Again, these plugs are separate parts which must be properly assembled and which must be manually removed before the cartridge is loaded in a machine and again are usually thrown away.

This presents a problem where a cartridge is removed for machine servicing or is replaced by another cartridge before the ribbon is used up, as for example, to change to a different color or type ribbon, and placed aside for later use. In these known structures, the chances for withdrawal of an excessive length of ribbon between exit and entry points, if the anti rotation device is not reinserted or reassembled, are apparent. As the separable anti rotation devices of the prior art are usually not saved, winding on the take-up spool of an excessive unused and, therefore, wasted length of withdrawn or unravelled and twisted ribbon is required before the cartridge with unspent ribbon can be remounted. Oftentimes, the twisted, unravelled ribbon cannot be wound up on the take-up spool.

In accordance with the invention, the problem attendant to the prior art assemblies are overcome in the provision of an anti rotation device which is an integral part of the cartridge and comprises a supply spool core insert supported by flexible webs or arms secured to the cartridge cover which allow the insert to be axially moved into and out of frictional engagement with the supply spool core rotatably mounted in the cartridge without separation from the cartridge. The engagement of the insert and supply spool core resists inadvertent rotation of the supply spool core relative to the cartridge yet allows rotation of the supply spool core as to allow ribbon to be withdrawn sufficient to track it around a printing element and through a ribbon vibrator or ribbon lift arms incident to mounting the cartridge in a machine.

An object of the invention is to provide a ribbon spool anti rotation device.

Another object of the invention is to provide a ribbon spool anti rotation device which is an integral part of a cartridge supporting ribbon spool cores and which is releasable to allow spool core rotation when the cartridge is mounted in a machine.

Other objects and many of the attendant advantages of this invention will be readily appreciated as the same becomes better understood by reference to the following detailled description when considered in connection with the accompanying drawing in which like reference numerals designate like parts throughout the FIGURES thereof and wherein.

Figure 1:
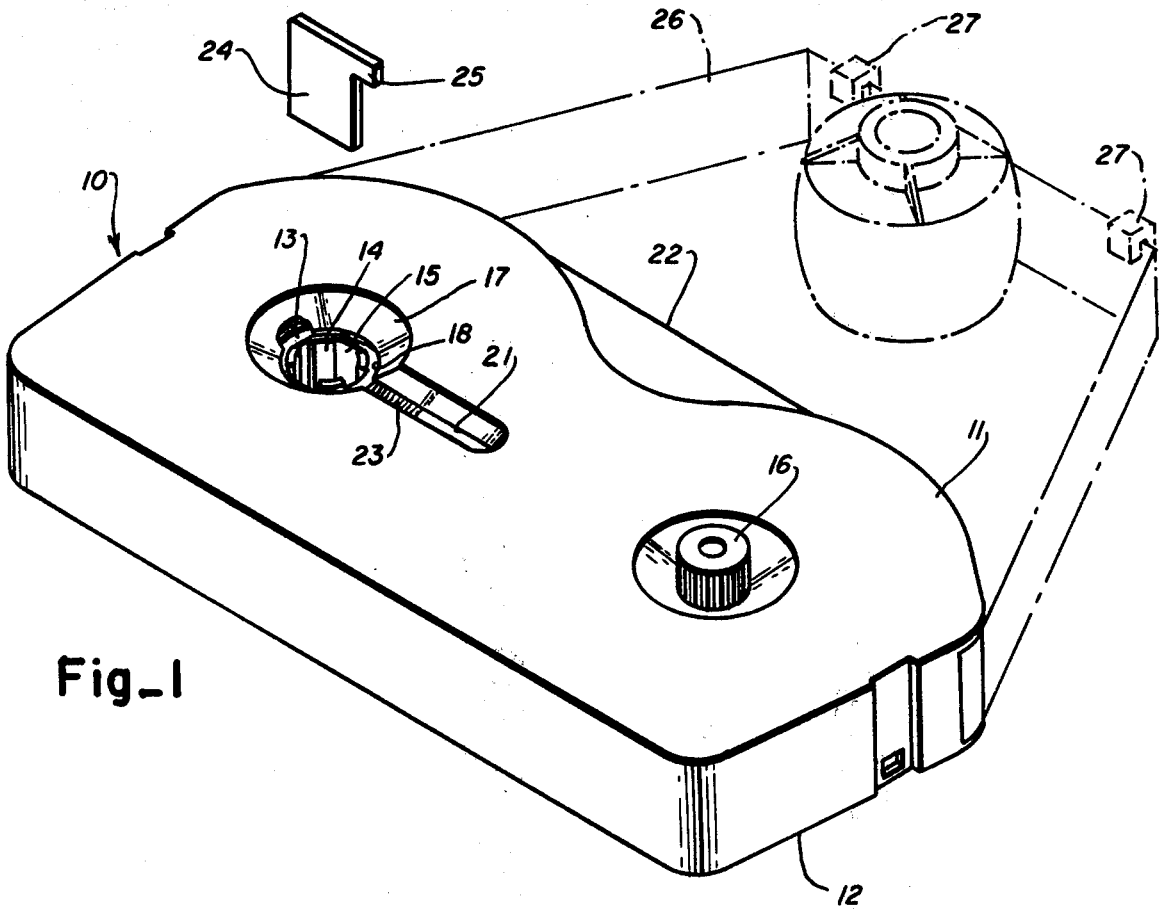
FIG. 1 is a perspective view of a prior art cartridge with an anti rotation device.
Figure 2:
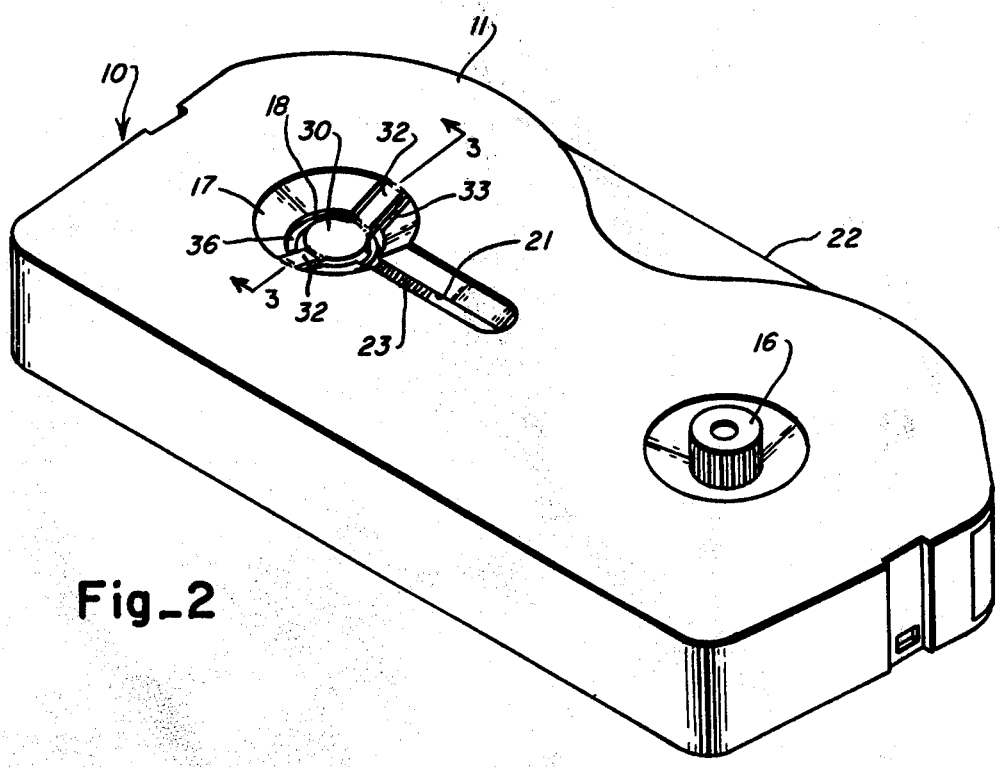
FIG. 2 is a perspective view of a cartridge in accordance with the invention.

Referring now to the drawing, there is shown in FIG. 1, a prior art cartridge generally designated by reference numeral 10 whose cover 11 and bottom wall 12 rotatably mount between them, in the left and right sides respectively, a flangeless hollow supply spool 13 having internal ribs 14 defining internal axial grooves 15, and a flangeless ribbon take-up spool (not shown) whose upper end extends through the cover 11 and is provided with a wind-up knob 16. As shown, the cartridge cover 11 is formed with a dished-out depression 17 which has a central circular opening 18 of smaller diameter than the spool 13 and an indicator slot 21 extending laterally to the right from opening 18 toward the take-up spool. As indicated in FIG. 1, the internal ribs 14 of the supply spool 13 extend upwardly through the opening 18 forming a discontinuous circular surface of a smaller diameter than the diameter of the opening 18 to loosely retain the spool 13 in axial alignment. As shown, a length 22 of ribbon 23 wound on the supply spool 13 extends from the supply spool 13 to the take-up spool exteriorly of the cartridge to ribbon exit and entry openings, not visible.

To prevent inadvertent withdrawal of ribbon 23 from the supply spool 13, a plug 24 is inserted in the hollow core of the supply spool 13 between opposite grooves 15 between ribs 14 and is provided with a radial arm 25 which rests within the indicator slot 21 to lock the supply spool 13 against relative rotation relative to the cartridge 10 until such time as the cartridge 10 is to be used.

To mount such a cartridge 10, the plug 24 must first be removed by hand to allow withdrawal of length 22 of ribbon to form, as shown in dotted lines in FIG. 1, a loop 26 as will permit the ribbon 23 to be threaded into ribbon lift arms 27 as by manipulation of the cartridge 10, before the cartridge 10 is mounted on the machine.

Figure 3:
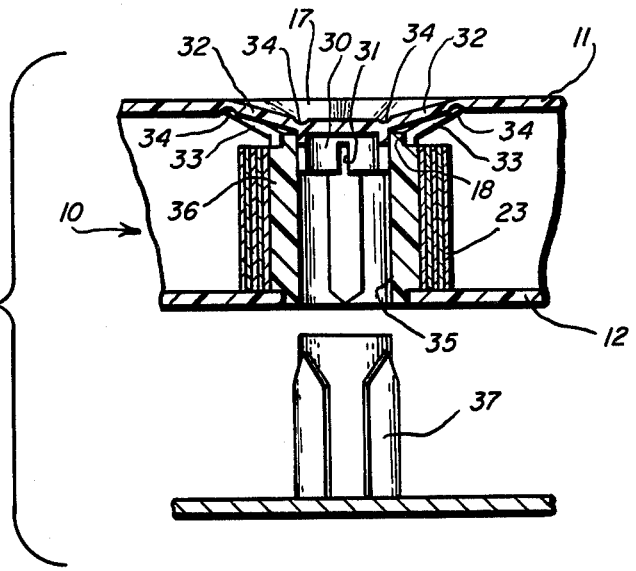
FIGS. 3 and 4 are cross-sectional views taken along lines 3—3 of FIG. 2 showing the position of the anti rotation device before and after mounting in a machine.
Figure 4:
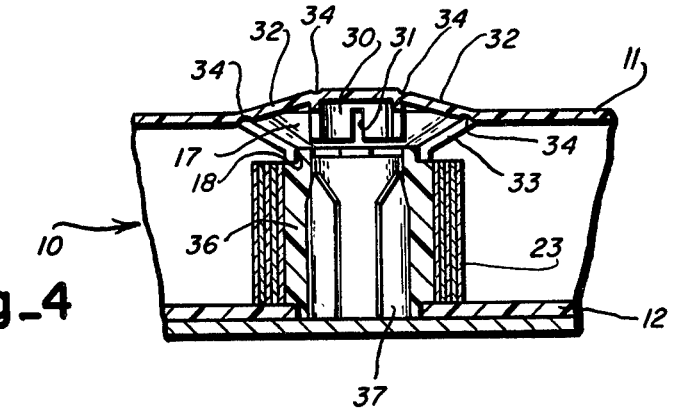
Figure 5:
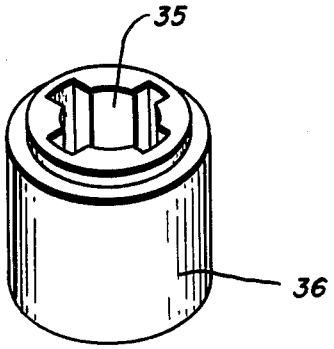
FIG. 5 is a perspective view of a supply spool core employed in the cartridge of the invention.

With reference to FIGS. 2–5, wherein a preferred embodiment of the invention is shown, a hollow anti spool rotation core insert 30 with axial slots 31 (FIGS. 3 and 4) to provide resiliency is molded with the cartridge cover 11 above the supply spool core retaining opening 18 and is connected to the cartridge cover 11 by two flexible 180° spaced bridges or arms 32. The dished-out depression 17 is formed with slots 33 located below arms 32 to allow sufficient movement of arms 32. The bridges 32 at their points 34 of connection to the cover 11 and to the core insert 30 are of reduced thickness to provide axial flexibility. The core insert 30 is inserted into a hollow internally grooved core 35 of a supply spool 36 upon cartridge assembly as shown in FIG. 3, thus to frictionally hold the supply spool 36 against rotation relative to the cartridge cover 11 as to preclude inadvertent unwinding of ribbon 23, yet allow the length 22 of ribbon 23 to be withdrawn sufficiently to allow a loop 36 thereof to be manipulatively threaded into the ribbon lift arms 27. Thereafter, upon mounting the cartridge 10, a splined spool support post 37 in the machine will axially push the core insert 30 out of frictional engagement with the spool core 35 to the position shown in FIG. 4 thereby to allow free rotation of the supply spool 36 as ribbon 23 is drawn therefrom during use onto the take-up spool; the axial movement of the core insert 30 being accomodated by an overcentering flexure of the bridges 32.

If for any reason the cartridge 10 is removed with unspent ribbon 23 remaining, the core insert 30 may be pressed back into the spool core 35 and prevent inadvertent unravelling of the ribbon 23 while placed aside, as would make it difficult to reinstall the cartridge.

The invention claimed is:

1. An inked ribbon cartridge having cover, side and bottom walls and hollow core ribbon supply and take-up spools rotatably mounted therein with ribbon extending from said supply to said take-up spool exteriorly of the cartridge through exit and entry openings in said side wall, said cover wall being formed with circular depressions and openings at the center of said depressions, and said bottom wall having openings aligned with said cover wall openings, said cover and bottom wall openings providing bearings for said rotatably mounted spools, means integrally formed with said cover wall and bridging the depression surrounding the cover wall opening rotatably supporting said supply spool, said means comprising a supply spool core insert, and arms resiliently connected to said cover wall and said core insert for supporting said core insert above said supply spool core and for permitting said core insert to be axially moved and pushed into frictional engagement with said supply spool core to restrain rotation of said supply spool, and to permit axial movement of said core insert out of frictional engagement with said supply spool core by a supply spool support post incident to mounting said cartridge in a machine.

2. An inked ribbon supply cartridge as recited in claim 1, said core insert having an inverted cup shape provided with axial slots therein to render it resilient and permit frictional engagement with said supply spool core.

3. An inked ribbon cartridge as recited in claim 2, said flexible arms extending from said core insert and said cover wall in opposite directions, and said depression being slotted to accommodate said flexible arms when said core insert is pushed into said supply spool core.

4. An inked ribbon cartridge as recited in claim 3, said connections of said arms to said cover wall and to said core insert allowing an axial overcentering action when said core insert is pushed out of engagement from said spool core.

* * * * *